US009095953B2

(12) United States Patent
Nakamori et al.

(10) Patent No.: US 9,095,953 B2
(45) Date of Patent: Aug. 4, 2015

(54) APPARATUS FOR POLISHING REAR SURFACE OF SUBSTRATE, SYSTEM FOR POLISHING REAR SURFACE OF SUBSTRATE, METHOD FOR POLISHING REAR SURFACE OF SUBSTRATE AND RECORDING MEDIUM HAVING PROGRAM FOR POLISHING REAR SURFACE OF SUBSTRATE

(75) Inventors: Mitsunori Nakamori, Koshi (JP); Noritaka Uchida, Koshi (JP); Takehiko Orii, Nirasaki (JP); Takanori Miyazaki, Koshi (JP); Nobuhiko Mouri, Koshi (JP)

(73) Assignee: Tokyo Electron Limited, Tokyo (JP)

( * ) Notice: Subject to any disclaimer, the term of this patent is extended or adjusted under 35 U.S.C. 154(b) by 865 days.

(21) Appl. No.: 13/158,600

(22) Filed: Jun. 13, 2011

(65) Prior Publication Data

US 2011/0312247 A1 Dec. 22, 2011

(30) Foreign Application Priority Data

Jun. 17, 2010 (JP) ..... 2010-138494
Sep. 24, 2010 (JP) ..... 2010-214538

(51) Int. Cl.
*B24B 7/22* (2006.01)
*B24B 51/00* (2006.01)
*B24B 37/04* (2012.01)

(52) U.S. Cl.
CPC ..... *B24B 37/042* (2013.01)

(58) Field of Classification Search
CPC ..... B24B 51/00; B24B 37/04; B24B 37/042; B24B 7/22
USPC ..... 451/5, 41, 37, 57, 65, 72, 73
See application file for complete search history.

(56) References Cited

U.S. PATENT DOCUMENTS 6,086,457 A * 7/2000 Perlov et al. ..... 451/41
2004/0072499 A1* 4/2004 Wakabayashi ..... 451/5
2004/0259470 A1* 12/2004 Swedek et al. ..... 451/5

FOREIGN PATENT DOCUMENTS

JP 1996-071511 A 3/1996
JP 11-300625 A 11/1999
JP 2002-307286 A 10/2002
JP 2004-063883 A 2/2004
JP 2009-125915 A 6/2009
JP 2009-214178 A 9/2009
JP 2009-214278 A 9/2009
JP 2010-046763 A 3/2010

* cited by examiner

*Primary Examiner* — Robert Rose
(74) *Attorney, Agent, or Firm* — Abelman, Frayne & Schwab

(57) ABSTRACT

Provided are a rear substrate surface polishing device polishing a rear surface of a substrate, a rear substrate surface polishing system including the rear substrate surface polishing device, a rear substrate surface polishing method used in the rear substrate surface polishing device, and a storage medium for storing a program implemented with the rear substrate surface polishing method. In particular, the rear surface of the substrate is polished by a substrate polishing unit in accordance with information acquired from a prior process performed prior to the polishing process of the rear surface of the substrate at the substrate polishing unit. Further, the substrate polishing unit polishes the substrate with a polishing area determined on the basis of information acquired from a prior process. Furthermore, the polishing is performed by using any one or all of a plurality of substrate polishing units determined on the basis of information acquired from a prior process.

9 Claims, 6 Drawing Sheets

APPARATUS FOR POLISHING REAR SURFACE OF SUBSTRATE, SYSTEM FOR POLISHING REAR SURFACE OF SUBSTRATE, METHOD FOR POLISHING REAR SURFACE OF SUBSTRATE AND RECORDING MEDIUM HAVING PROGRAM FOR POLISHING REAR SURFACE OF SUBSTRATE

CROSS-REFERENCE TO RELATED APPLICATIONS

This application is based on and claims priority from Japanese Patent Application Nos. 2010-138494 and 2010-214538, filed on Jun. 17, 2010 and Sep. 24, 2010, respectively, with the Japanese Patent Office, the disclosures of which are incorporated herein in their entireties by reference.

TECHNICAL FIELD

The present disclosure relates to an apparatus for polishing the rear surface of substrate, system for polishing the rear surface of substrate, method for polishing the rear surface of substrate and recording medium having program for polishing the rear surface of substrate.

BACKGROUND

In producing semiconductor components and flat panel displays, various processes such as etching, coating, cleaning or carrying of a substrate are repetitively performed while horizontally holding the rear surface of a substrate such as a semiconductor wafer or a liquid crystal substrate by a substrate holding unit.

Since the rear surface of the substrate contacts the substrate holding unit when various processes are performed, convex portions may be formed at the rear surface of the substrate.

While the rear surface of the substrate having the convex portions is cleaned by a scrubber adopting a brush, it is difficult to satisfactorily remove the convex portions and planarize the rear surface of the substrate.

Therefore, a method may be conceived which planarizes the rear surface of the substrate by polishing the entire rear surface of the substrate uniformly using, for example, an apparatus disclosed in Japanese Patent Application Laid-Open No. H08-71511.

SUMMARY

An exemplary embodiment of the present disclosure provides an apparatus for polishing the rear surface of a substrate including: a substrate polishing unit which polishes the rear surface of the substrate; and a control unit which controls the substrate polishing unit. In particular, the control unit controls the operation of the substrate polishing unit in accordance with information acquired from a prior process performed prior to the polishing process of the rear surface of the substrate.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
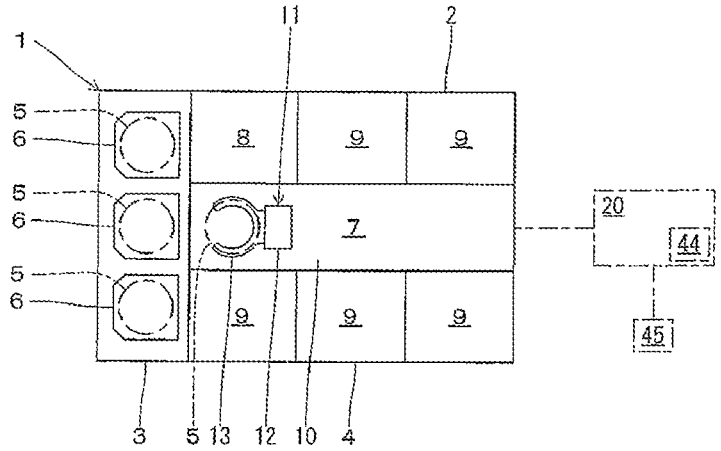
FIG. 1 is a plan view illustrating a rear substrate surface polishing system.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

When the rear surface of the substrate is polished by using conventional devices, since the entire rear surface of the substrate is polished uniformly, even a portion where the convex portions are not formed is unnecessarily polished. As a result, there is a concern that throughput may be reduced due to the extended polishing time.

Moreover, since the polishing member is unnecessarily abraded, the life span of the polishing member is shortened, and the labor, time, or cost necessary for replacing the polishing member increases.

According to an aspect of the present disclosure, there is provided a rear substrate surface polishing device including: a substrate polishing unit configured to polish the rear surface of a substrate; and a control unit configured to control the substrate polishing unit. In particular, the control unit controls an operation of the substrate polishing unit in accordance with information acquired from a prior process performed prior to the polishing process of the rear surface of the substrate.

In the rear substrate surface polishing device, the control unit may control the substrate polishing unit with a polishing range determined on the basis of the information acquired from a prior process performed prior to the polishing process of the rear surface of the substrate to perform the polishing process.

The rear substrate surface polishing device further includes a plurality of types of substrate polishing units, and the control unit may control any one or all of the substrate polishing units determined on the basis of the information acquired from a prior process performed prior to the polishing process of the rear surface of the substrate to perform the polishing process.

The rear substrate surface polishing device further includes a substrate cleaning unit which cleans the rear surface of the substrate, and the control unit may control the substrate cleaning unit to clean the rear surface of the substrate after the rear surface is polished by the substrate polishing unit.

The substrate polishing unit may have a configuration in which a polishing member is connected to a rotation shaft via a shock absorbing member which is formed of an elastic and deformable material.

The polishing member of the substrate polishing unit may be formed of a base material containing powders harder than the substrate.

The polishing member may be formed in a brush shape in which a plurality of brush bristles are implanted into a base.

The polishing member may be formed of a material harder than the substrate, and the edge portion of the polishing member contacting the substrate may be formed to be round.

The polishing member may be formed in a spherical shape or a donut shape.

According to another aspect of the present disclosure, there is provided a rear substrate surface polishing system including: a substrate polishing unit configured to polish the rear surface of a substrate; a control unit configured to control the substrate polishing unit; and a substrate carrying unit configured to load and unload the substrate to the substrate polishing unit. In particular, the control unit controls an operation of the substrate polishing unit in accordance with information acquired from a prior process performed prior to the polishing process of the rear surface of the substrate.

According to still another aspect of the present disclosure, there is provided a rear substrate surface polishing method of polishing a rear surface of a substrate by controlling a substrate polishing unit using a control unit. In particular, the control unit controls an operation of the substrate polishing unit in accordance with information acquired from a prior process performed prior to the polishing process of the rear surface of the substrate.

In the rear substrate surface polishing method, the control unit may control the substrate polishing unit with a polishing range determined on the basis of information acquired from a prior process performed prior to the polishing process of the rear surface of the substrate to perform the polishing process.

In the rear substrate surface polishing method, the control unit may control a plurality of types of substrate polishing units, and control any one or all of the substrate polishing units determined on the basis of information acquired from a prior process performed prior to the polishing process of the rear surface of the substrate to perform the polishing.

In the rear substrate surface polishing method, the control unit may control the substrate cleaning unit to clean the rear surface of the substrate after the rear surface is polished by the substrate polishing unit.

According to still another aspect of the present disclosure, there is provided a storage medium storing a program for polishing the rear surface of substrate by controlling a substrate polishing unit polishing the rear surface of the substrate using a control unit. In particular, the control unit controls an operation of the substrate polishing unit in accordance with information acquired from a prior process performed prior to the polishing process of the rear surface of the substrate.

In the storage medium storing the program for polishing the rear surface of substrate, the control unit may control the substrate polishing unit with a polishing range determined on the basis of information acquired from a prior process performed prior to the polishing process of the rear surface of the substrate.

In the storage medium storing the program for polishing the rear surface of substrate, the control unit may control a plurality of types of substrate polishing units, and control any one or all of the substrate polishing units determined on the basis of information acquired from a prior process performed prior to the polishing process of the rear surface of the substrate to perform the polishing.

In the storage medium storing the program for polishing the rear surface of substrate, the control unit may control the substrate cleaning unit to clean the rear surface of the substrate after the rear surface is polished by the substrate polishing unit.

According to the above-described configuration, the rear surface of the substrate is polished by controlling the operation of the substrate polishing unit in accordance with information acquired from a prior process performed prior to the polishing process of the rear surface of the substrate at the substrate polishing unit, and thus, the rear surface of the substrate may be sufficiently polished. Accordingly, a reduction in throughput or a degradation of a substrate due to the polishing of the rear surface of the substrate may be prevented, and the life span of the polishing member may be increased. Therefore, labor, time, or cost necessary for replacing the polishing member may be reduced.

Hereinafter, a detailed configuration of the present disclosure will be described by referring to the drawings.

As shown in FIG. 1, a rear substrate surface polishing system 1 (e.g., a system for polishing the rear surface of a substrate) has a configuration in which a substrate loading-unloading table 3 is provided at the front end portion of a casing 2, and a substrate processing chamber 4 is provided at the rear portion of the substrate loading-unloading table 3.

A plurality of carriers 6 (e.g., 3 units in this example) are placed on substrate loading-unloading table 3 while being arranged in a left/right direction, where each of carriers 6 accommodates a plurality of substrates 5 (e.g., 25 semiconductor wafers).

Substrate loading-unloading table 3 is configured to load and unload substrates 5 between each carrier 6 and substrate processing chamber 4 provided at the rear portion thereof.

Substrate processing chamber 4 has a configuration in which a substrate carrying device 7 is disposed at the center thereof, a substrate reversing device 8 and two rear substrate surface polishing devices 9 (e.g., an apparatus for polishing the rear surface of substrate) are disposed at the left portion of the substrate carrying device 7 while being arranged in the front/rear direction, and three rear substrate surface polishing devices 9 are disposed at the right portion of substrate carrying device 7 while being arranged in the front/rear direction.

Substrate processing chamber 4 receives one substrate 5 from a predetermined carrier 6 of substrate loading-unloading table 3 using substrate carrying device 7 while the front surface of substrate 5 faces upward, and substrate carrying device 7 transfers substrate 5 to substrate reversing device 8. The front and rear surfaces of substrate 5 are then reversed by substrate reversing device 8, and substrate processing chamber 4 receives substrate 5 from substrate reversing device 8 using substrate carrying device 7 while the rear surface of substrate 5 faces upward. Substrate carrying device 7 then sends substrate 5 to a predetermined apparatus for polishing the rear surface of substrate 9 where the rear surface of substrate 5 is polished. Subsequently, substrate carrying device 7 carries substrate 5 from rear substrate surface polishing device 9 to substrate reversing device 8 to reverse the front and rear surfaces of substrate 5, and substrate processing chamber 4 receives substrate 5 from substrate reversing device 8 using substrate carrying device 7 while the front surface of the substrate faces upward. Substrate 5 is then sent to a predetermined carrier 6 of substrate loading-unloading table 3 via substrate carrying device 7.

Substrate carrying device 7 accommodates a substrate carrying unit 11 inside a carriage chamber 10 extending in the front/rear direction so as to hold and carry substrates 5 one by one.

Substrate carrying unit 11 has a configuration in which an arm 13 holding one substrate 5 is attached to a running table 12 running in the front/rear direction so that arm 13 may be reciprocated, elevated, and rotated with respect thereto.

Substrate carrying device 7 is configured to carry substrates 5 one by one using substrate carrying unit 11 between substrate loading-unloading table 3 and substrate reversing device 8, or between substrate reversing device 8 and each rear substrate surface polishing device 9.

Substrate reversing device 8 is configured to reverse the front and rear surfaces of substrate 5 received from substrate carrying device 7, and send substrate 5 back to substrate carrying device 7 again.

Figure 2:
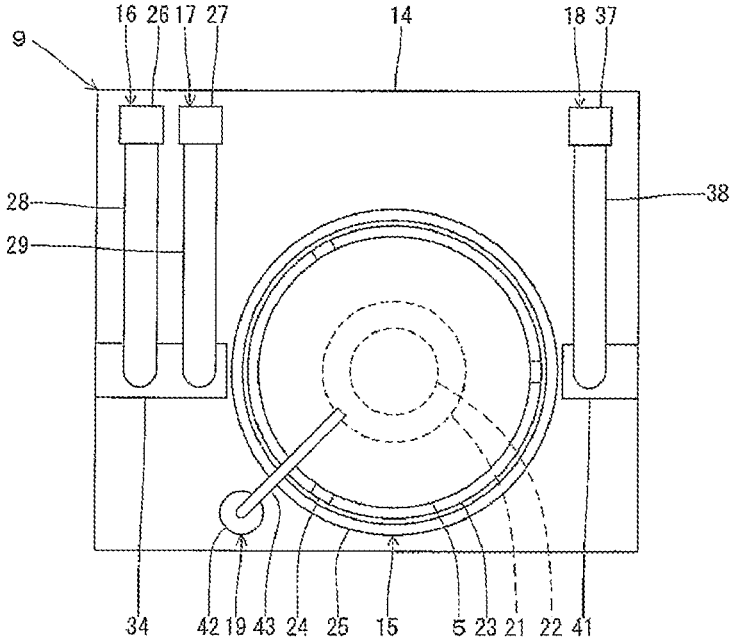
FIG. 2 is a plan view illustrating a rear substrate surface polishing device.
Figure 3:
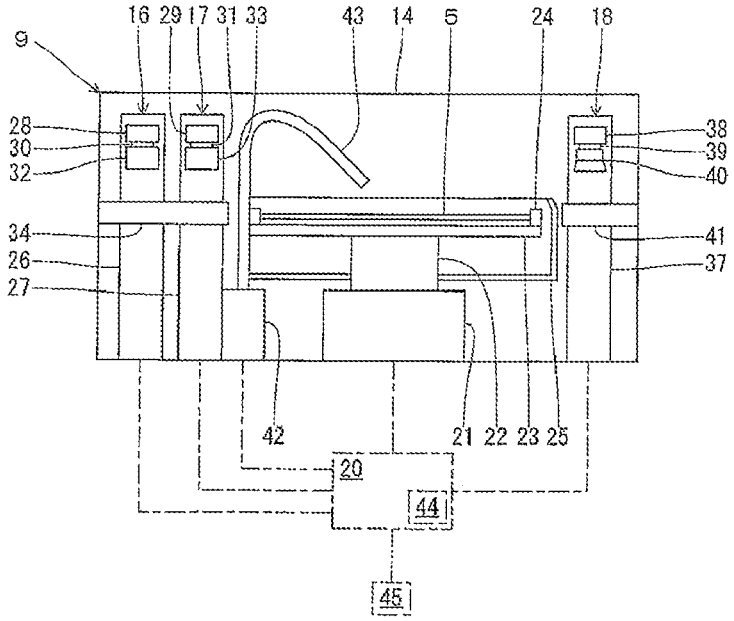
FIG. 3 is a front view illustrating the rear substrate surface polishing device.

As shown in FIGS. 2 and 3, each rear substrate surface polishing device 9 includes inside a casing 14 a substrate holding unit 15 holding substrate 5, first and second substrate polishing units 16 and 17 polishing substrate 5, a substrate cleaning unit 18 cleaning the rear surface of substrate 5, and a deionized water supply unit 19 supplying deionized water to the rear surface of substrate 5, where these units are accommodated. Substrate holding unit 15, first and second substrate polishing units 16 and 17, substrate cleaning unit 18, and deionized water supply unit 19 are connected to the control unit 20, and the operation thereof is controlled by control unit 20. Further, control unit 20 is configured to control not only rear substrate surface polishing device 9, but also substrate carrying device 7 and substrate reversing device 8.

Substrate holding unit 15 has a configuration in which a driving motor 21 is attached to the center of the bottom of casing 14, a disc-like turntable 23 is horizontally attached to a driving shaft 22 of driving motor 21, three chucks 24 are attached to the edge portion of the upper surface of turntable 23 at an interval in the circumferential direction to hold the outer peripheral edge portion of substrate 5, and an elevatable cup 25 covers the outer peripheral side of turntable 23. Control unit 20 controls the operation of driving motor 21 (e.g., turntable 23), the operation of chucks 24, or the elevation of cup 25.

First and second substrate polishing units 16 and 17 are disposed at the rear portion of casing 14 while being arranged in the left/right direction, moving tables 26 and 27 extending in the up/down direction are attached to the left rear side of the bottom of casing 14 to be movable in the left/right direction, arms 28 and 29 extending in the front/rear direction are respectively attached to the upper portions of moving tables 26 and 27 to be elevatable, rotation shafts 30 and 31 extending in the up/down direction are respectively attached to the lower portions of the front end portions of arms 28 and 29 to be rotatable, and polishing members 32 and 33 are respectively attached to the lower end portions of rotation shafts 30 and 31. Control unit 20 controls the movement of moving tables 26 and 27, the elevation of arms 28 and 29, or the rotation of rotation shafts 30 and 31 (e.g., polishing members 32 and 33).

First and second substrate polishing units 16 and 17 include a polishing member cleaning unit 34 which is provided at the left wall of casing 14 to clean polishing members 32 and 33 or perform the maintenance thereof.

As shown in FIG. 4A, first substrate polishing unit 16 has a configuration in which polishing member 32 is attached to the lower end portion of rotation shaft 30 via a shock absorbing member 35 which is formed of a cylindrical elastic and deformable material such as PVA. As shown in FIG. 4B, second substrate polishing unit 17 has a configuration in which polishing member 33 is directly attached to the lower end portion of rotation shaft 31, where polishing member 33 is formed of cylindrical PVA or the like softer than polishing member 32 of first substrate polishing unit 16.

As described above, first substrate polishing unit 16 has a configuration in which polishing member 32 is attached to rotation shaft 31 via shock absorbing member 35. Accordingly, even when substrate 5 is warped or bent, polishing member 32 may polish the front surface of substrate 5 along the warpage. For this reason, the front surface of substrate 5 may be satisfactorily polished without being partially polished or scratched.

Figure 4:
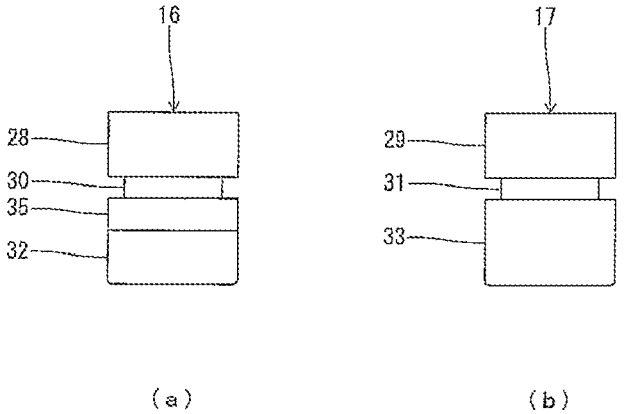
FIGS. 4A and 4B are front views illustrating a substrate polishing unit.
Figure 11:
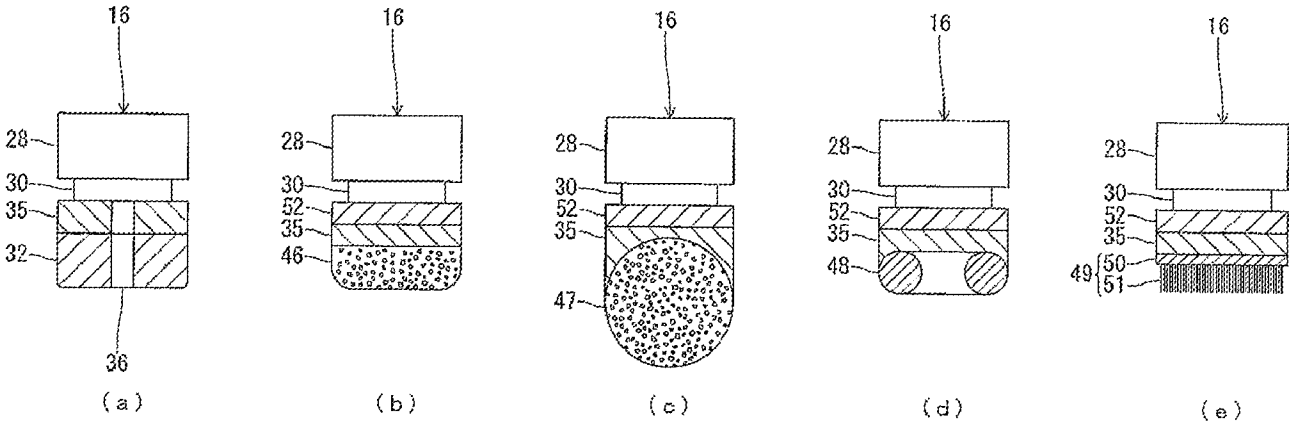
FIGS. 11A to 11E are front cross-sectional views illustrating modified examples of the substrate polishing unit.

First and second substrate polishing units 16 and 17 are not limited to have the configuration shown in FIG. 4, but may have a different configuration. For example, as shown in FIG. 11A, first and second substrate polishing units 16, 17 may have a configuration in which a communication hole 36 is formed at the center of polishing member 32 (33) and a fluid (e.g., a liquid such as deionized water, or a gas such as an inert gas) is discharged from communication hole 36 along with the upward movement of polishing member 32 (33). When polishing member 32 (33) is formed in a cylindrical shape, there is a concern that the lower end surface of polishing member 32 (33) may adhere to the front surface of substrate 5 after polishing and substrate 5 is also lifted up with the upward movement of polishing member 32 (33). However, since a fluid (e.g., deionized water or inert gas) is discharged from communication hole 36 along with the upward movement of polishing member 32 (33), polishing member 32 (33) may be easily separated from substrate 5.

The present disclosure is not limited to the configuration in which polishing member 32 (33) is formed of ceramic or a grindstone, a material harder than substrate 5 which is a member to be polished, and polishing member 32 (33) may be formed of a base material containing powders harder than substrate 5. For example, when substrate 5 is formed of silicon, polishing member 32 (33) may be formed of nylon as a base material containing powders of silicon carbide, alumina, diamond, or the like. The particle diameter of the powder may be about 1 mm or less. Further, powders may be mixed with the base material by kneading or adhering. Likewise, when polishing member 32 (33) is formed of a base material containing powders harder than substrate 5, the front surface of substrate 5 may be satisfactorily polished by the powders and polishing member 32 (33) may be prevented from adhering to the front surface of substrate 5.

As shown in FIG. 11B, first substrate polishing unit 16 may have a configuration in which a pedestal 52 is attached to the lower end portion of rotation shaft 30, and a polishing member 46 is attached to the lower surface of pedestal 52 via shock absorbing member 35, or the edge portion of the lower end surface of polishing member 46 contacting substrate 5 may be formed to be round. Alternatively, polishing member 47 may be formed in a spherical shape as shown in FIG. 11C, or in a donut shape in which a tubular member is disposed in an annular shape as shown in FIG. 11D. Further, the diameter of polishing member 32 may be formed as small as possible, and in this case, a plurality of thin polishing members may polish substrate 5. Also, a communication hole may be formed at the center of each of polishing members 47 and 48 to discharge a fluid therethrough.

Further, as shown in FIG. 11E, polishing member 49 may be formed in a brush shape in which a plurality of brush bristles 51 are implanted into a base 50. In this case, brush bristle 51 may be formed of a base material containing powders harder than substrate 5 so that brush bristle 51 is flexible and the front end portion of brush bristle 51 contacting substrate 5 is round.

In this manner, the lower edge portion of the polishing member is formed to be round, in a spherical shape, a donut shape, or a brush shape, or is formed to have a smaller diameter. Accordingly, even when substrate 5 is warped or bent, the polishing member may polish the front surface of the substrate 5 along with the warpage upon polishing substrate 5. For this reason, the front surface of substrate 5 may be satisfactorily polished without being partially polished or scratched. Further, since the contact area with respect to substrate 5 becomes smaller than that of the cylindrical shape, the polishing member may be prevented from adhering to the front surface of substrate 5.

Further, in rear substrate surface polishing device 9, any one of hardness, a material, and a configuration of polishing member 32 of first substrate polishing unit 16 is different from that of polishing member 33 of second substrate polishing unit 17. However, the present disclosure is not limited to the case where two different types of first and second substrate polishing units 16 and 17 are used as the substrate polishing unit. That is, three types or more of substrate polishing units may be provided, one type of a substrate polishing unit may be provided, or one type of a plurality of substrate polishing units may be provided.

Substrate cleaning unit 18 has a configuration in which a moving table 37 extending in the up/down direction is attached to the right rear side of the bottom of casing 14 to be movable in the left/right direction, an arm 38 extending in the front/rear direction is attached to the upper portion of moving table 37 to be elevatable, a rotation shaft 39 extending in the up/down direction is attached to the lower portion of the front end portion of arm to be rotatable, and a brush 40 serving as a cleaning member is attached to the lower end portion of rotation shaft 39. Control unit 20 controls the movement of moving table 37, the elevation of arm 38, or the rotation of rotation shaft 39 (brush 40). Further, the cleaning member is not limited to brush 40, and may be a sponge, two fluid nozzles, or the like.

Substrate cleaning unit 18 includes a brush cleaning unit 41 which is provided at the right wall of casing 14 to clean brush 40 or perform the maintenance thereof.

Deionized water supply unit 19 has a configuration in which a flow control mechanism 42 is attached to the left front side of the bottom of casing 14, a nozzle 43 is connected to flow control mechanism 42, and deionized water is supplied from the front end of nozzle 43 toward the center of the front surface of substrate 5.

Rear substrate surface polishing system 1 has the above-described configuration, and the operation thereof is controlled by control unit 20 in accordance with various programs stored in a storage medium 44 to process substrate 5. Here, storage medium 44 stores, for example, various setting data items or various programs such as a rear substrate surface polishing program to be described later, and may be configured as a memory such as a ROM or a RAM, or a disc-like storage medium such as a hard disc, a CD-ROM, a DVD-ROM, or a flexible disc which may be obtained in the market.

The rear surface of substrate 5 is polished by rear substrate surface polishing device 9 in accordance with the rear substrate surface polishing program stored in the storage medium provided in control unit 20, as described below.

The rear substrate surface polishing program first acquires information related to a process at a preceding step (an upstream-side step) performed earlier than the polishing step of the rear surface of substrate 5 using control unit 20.

Here, information related to the process at the preceding step performed earlier than the polishing step of the rear surface of substrate 5 may include, for example, information on the position where the rear surface of substrate 5 is held (e.g., the position where a convex portion may be formed at the rear surface of substrate 5), and information on the size or the position (e.g., the height or the area) of the convex portion detected by actually measuring the rear surface of substrate 5.

The information related to the process at the preceding step of substrate 5 may be input to control unit 20 using an input device 45 connected to control unit 20 or may be input to control unit 20 via on-line from a substrate processing device such as a cleaning device used in the preceding step of substrate 5.

The program for polishing the rear surface of substrate determines the polishing range of actual polishing of the rear surface of substrate 5 or the polishing conditions (e.g., a pressing force that substrate polishing units 16 and 17 exerts on substrate 5, a moving speed of substrate polishing units 16 and 17, a rotating speed of polishing members 32 and 33, a rotating speed of substrate 5) on the basis of the information related to the process at the preceding step of substrate 5 acquired from control unit 20, and polishes the rear surface of substrate 5 according to the determined polishing range as the polishing conditions.

The program for polishing the rear surface of substrate may be configured to polish the rear surface of substrate 5 by selecting any one of first and second substrate polishing units 16 and 17 on the basis of the information related to the process at the preceding step of substrate 5, polish the rear surface of substrate 5 using substrate polishing units 16 and 17, and polish the rear surface of substrate 5 by setting the polishing areas or the polishing conditions of first substrate polishing unit 16 and second substrate polishing unit 17 to be different from each other. In the following description, a exemplary case will be described in which the rear surface of substrate 5 is polished by using both first and second substrate polishing units 16 and 17.

In the program for polishing the rear surface of substrate, substrate 5 loaded on the upper portion of turntable 23 of substrate holding unit 15 using substrate carrying device 7 is horizontally held by chucks 24 while the rear surface opposite to the circuit formation surface of substrate 5 is made to face upward using substrate reversing device 8.

Figure 5:
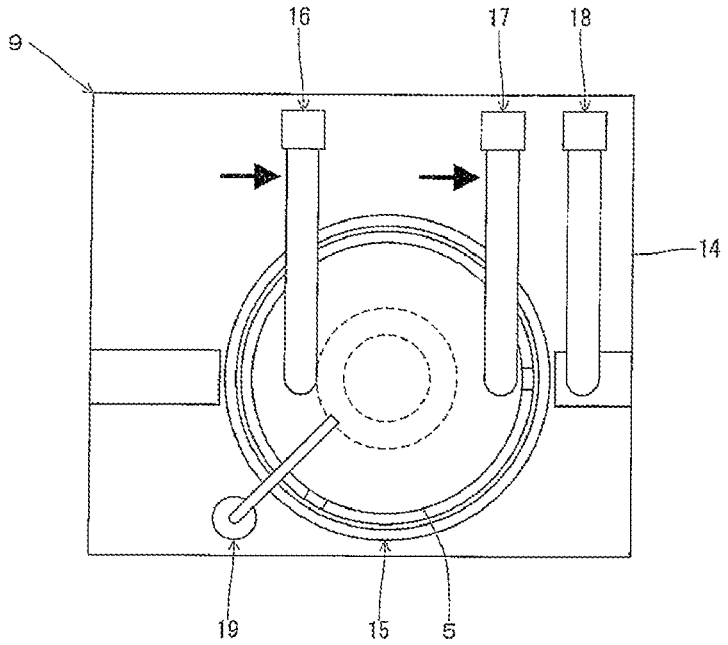
FIG. 5 is a diagram illustrating an operation of the rear substrate surface polishing device.

Subsequently, as shown in FIG. 5, second substrate polishing unit 17 is moved to the retreat position at the right side of substrate 5, and first substrate polishing unit 16 is moved to the polishing start position of the polishing range determined on the basis of the information related to the process at the preceding step.

Figure 6:
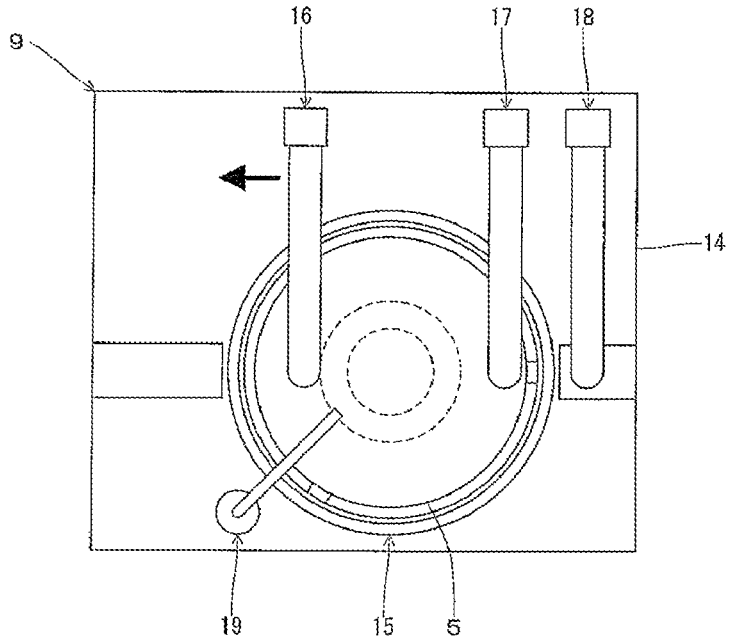
FIG. 6 is a diagram illustrating an operation of the rear substrate surface polishing device.

Next, as shown in FIG. 6, turntable 23 of substrate holding unit 15 is rotated to rotate substrate 5 while being held in the horizontal direction, deionized water is supplied from nozzle 43 of deionized water supply unit 19 toward the rear surface of substrate 5, and polishing member 32 of first substrate polishing unit 16 is moved by a necessary polishing range from the center of the rear surface of substrate 5 toward the outer peripheral edge portion thereof while polishing member 32 rotates to come into close contact with the rear surface of substrate 5 with the deionized water interposed therebetween. At this time, first substrate polishing unit 16 is driven with the rpm and the pressing force determined on the basis of information related to the process at the preceding step.

As described above, the program for polishing the rear surface of substrate does not polish the entire rear surface of substrate 5 using first substrate polishing unit 16, but polishes only a predetermined range of the rear surface of substrate 5 with a predetermined rpm and a predetermined pressing force, where the predetermined range is determined on the basis of information of the preceding step.

Figure 7:
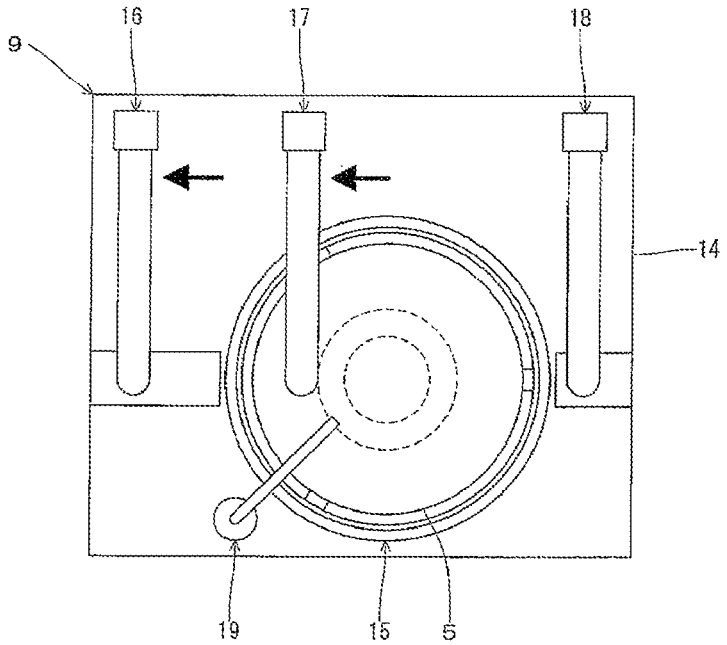
FIG. 7 is a diagram illustrating an operation of the rear substrate surface polishing device.

Subsequently, in the program for polishing the rear surface of substrate, as shown in FIG. 7, first substrate polishing unit 16 is moved to the initial position at the left side of substrate 5, and second substrate polishing unit 17 is moved to a starting position of the polishing range determined on the basis of information related to the process at the preceding step.

Figure 8:
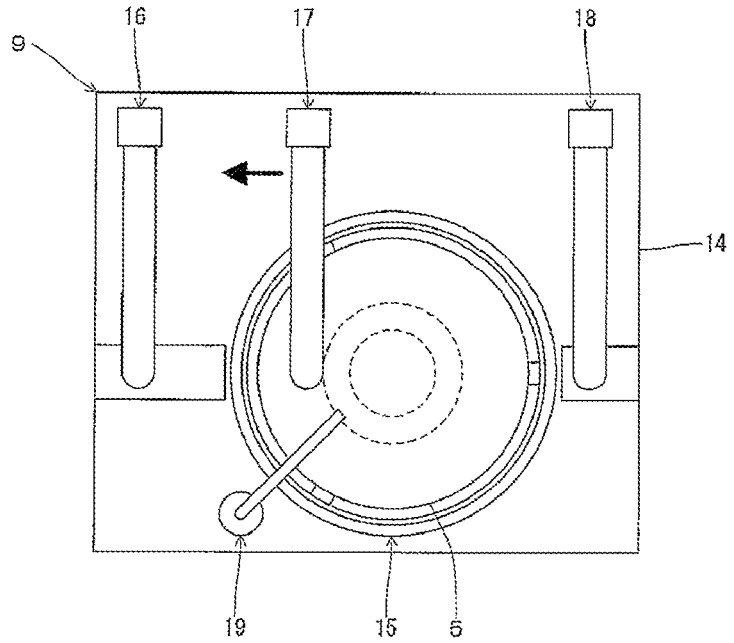
FIG. 8 is a diagram illustrating an operation of the rear substrate surface polishing device.

Next, as shown in FIG. 8, turntable 23 of substrate holding unit 15 is rotated to rotate substrate 5 while being held in the horizontal direction, deionized water is supplied from nozzle 43 of deionized water supply unit 19 toward the rear surface of substrate 5, and polishing member 33 of first substrate polishing unit 17 is moved by a necessary polishing range from the center of the rear surface of substrate 5 toward the outer peripheral edge portion thereof while polishing member 33 rotates to come into close contact with the rear surface of substrate 5 with the deionized water interposed therebetween. At this time, second substrate polishing unit 17 is driven with the rpm and the pressing force determined on the basis of information related to the process at the preceding step.

In this manner, the program for polishing the rear surface of substrate does not polish the entire rear surface of substrate 5 using second substrate polishing unit 17, but polishes only a predetermined range of the rear surface of substrate 5 with a predetermined rpm and a predetermined pressing force, where the predetermined range is determined on the basis of information of the preceding step.

Figure 9:
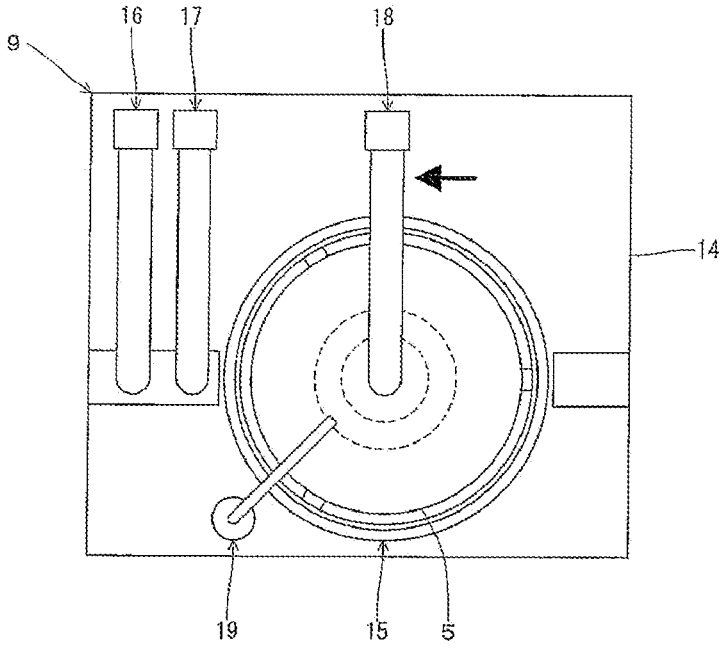
FIG. 9 is a diagram illustrating an operation of the rear substrate surface polishing device.

Subsequently, in the program for polishing the rear surface of substrate, as shown in FIG. 9, second substrate polishing unit 17 is moved to the initial position at the left side of substrate 5, and substrate cleaning unit 18 is moved to the center position of substrate 5.

Figure 10:
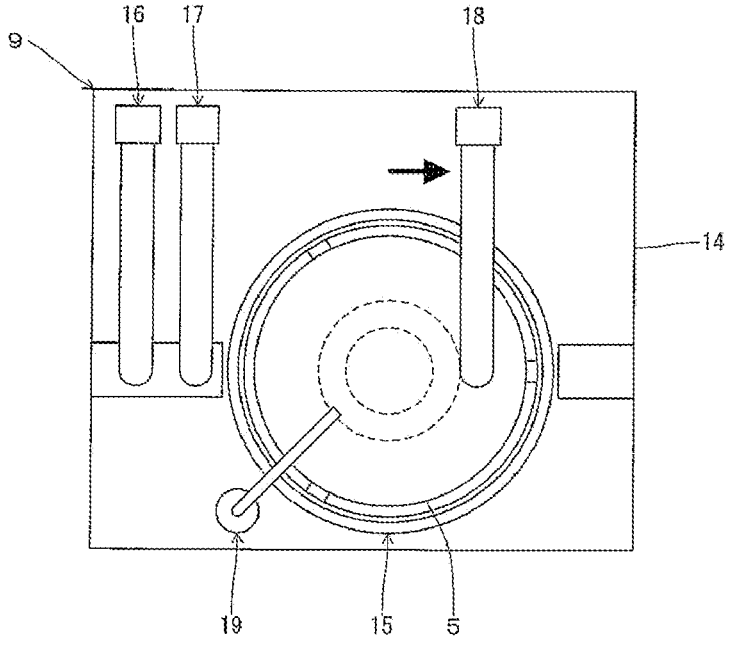
FIG. 10 is a diagram illustrating an operation of the rear substrate surface polishing device.

Next, as shown in FIG. 10, turntable 23 of substrate holding unit 15 is rotated to rotate substrate 5 while being held in the horizontal direction, deionized water is supplied from nozzle 43 of the deionized water supply unit 19 toward the rear surface of substrate 5, and brush 40 of substrate cleaning unit 18 is moved from the center of the rear surface of substrate 5 toward the outer peripheral edge portion thereof while brush 40 rotates to come into close contact with the rear surface of substrate 5 with the deionized water interposed therebetween, thereby cleaning the entire rear surface of substrate 5 using substrate cleaning unit 18.

Subsequently, substrate 5 is unloaded from the upper portion of turntable 23 to substrate reversing device 8 using substrate carrying device 7.

As described above, the rear surface of substrate 5 is polished in the program for polishing the rear surface of substrate.

In rear substrate surface polishing device 9 of rear substrate surface polishing system 1, the operation of substrate polishing units 16 and 17 is controlled in accordance with information related to the process at the preceding step of substrate 5 to polish the rear surface of substrate 5. For this reason, since the rear surface of substrate 5 may be polished only for a necessary and sufficient amount, a reduction in throughput due to the polishing process of the rear surface of substrate 5 may be prevented. Furthermore, since the life span of polishing members 32 and 33 may be increased, the labor, the time, or the cost necessary for replacing polishing members 32 and 33 may be reduced.

In particular, when the rear surface of substrate 5 is polished by using a plurality of types of substrate polishing units 16 and 17 or selectively using a plurality of types of substrate polishing units 16 and 17, the rear surface of substrate 5 may be satisfactorily polished in accordance with the state of substrate 5 such as the size of a convex portion at the rear surface thereof.

Further, when the polishing range at the rear surface of substrate 5 is restricted to a specific range instead of the entire rear surface, the process time necessary for polishing the rear surface of substrate 5 may be shortened.

Furthermore, when the rear surface of substrate 5 is cleaned by substrate cleaning unit 18 after the rear surface of substrate 5 is polished, particles or the like generated by the polishing of the rear surface of substrate 5 may be excluded, so that the particles may be prevented from adhering to the front surface of substrate 5 again.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An apparatus for polishing a substrate comprising:

a substrate polishing unit configured to polish a rear surface of the substrate which is an opposite surface to a circuit formation surface of the substrate;

a substrate cleaning unit including one of a brush, a sponge or a fluid nozzle configured to clean the rear surface of the substrate; and a control unit configured to control the substrate polishing unit and the substrate cleaning unit, wherein the control unit is programmed to selectively polish only a convex portion of the rear surface of the substrate in accordance with information acquired from a process performed on the substrate prior to its loading to the substrate polishing unit, and to clean the substrate in its entirety after the rear surface of the substrate is polished by the substrate polishing unit.

2. The apparatus for polishing a substrate of claim 1, wherein the control unit controls the substrate polishing unit with a polishing range determined on the basis of information acquired from the prior process performed prior to the polishing process of the rear surface of the substrate to perform the polishing process.

3. The apparatus for polishing a substrate of claim 1, further comprising:

a plurality of types of substrate polishing units, wherein the control unit controls any one or all of the substrate polishing units determined on the basis of information acquired from a prior process performed prior to the polishing process of the rear surface of the substrate to perform the polishing process.

4. The apparatus for polishing a substrate of claim 1, wherein the substrate polishing unit has a configuration in which a polishing member is connected to a rotation shaft via a shock absorbing member which is formed of an elastic and deformable material.

5. The apparatus for polishing a substrate of claim 4, wherein the polishing member of the substrate polishing unit is formed of a base material containing powders harder than the substrate.

6. The apparatus for polishing a substrate of claim 5, wherein the polishing member is formed in a brush shape in which a plurality of brush bristles are implanted into a base.

7. The apparatus for polishing a substrate of claim 4, wherein the polishing member is formed of a material harder than the substrate, and the edge portion of the polishing member contacting the substrate is formed to be round.

8. The apparatus for polishing a substrate of claim 7, wherein the polishing member is formed in a spherical shape or a donut shape.

9. A system for polishing a substrate comprising:

a substrate polishing unit configured to polish a rear surface of the substrate which is an opposite surface to a circuit formation surface of the substrate;

a substrate cleaning unit including one of a brush, a sponge or a fluid nozzle configured to clean the rear surface of the substrate;

a control unit configured to control the substrate polishing unit and the substrate cleaning unit; and a substrate carrying unit configured to load and unload the substrate to the substrate polishing unit, wherein the control unit is programmed to selectively polish only a convex portion of the rear surface of the substrate in accordance with information acquired from a process performed on the substrate prior to its loading to the substrate polishing unit by the substrate carrying unit, and to clean the substrate in its entirety after the rear surface of the substrate is polished by the substrate polishing unit.

* * * * *